United States Patent [19]

Hill et al.

[11] 4,037,419

[45] July 26, 1977

[54] MINE ROOF SUPPORT

[75] Inventors: Nigel Hill; James Anthony Sutton, both of Cheltenham, England

[73] Assignee: Dowty Mining Equipment Limited, Tewkesbury, England

[21] Appl. No.: 641,939

[22] Filed: Dec. 18, 1975

[30] Foreign Application Priority Data

Dec. 18, 1974 United Kingdom ..... 54780/74

[51] Int. Cl.[2] ..... E21D 15/44

[52] U.S. Cl. ..... 61/45 D; 248/357

[58] Field of Search ..... 61/45 D, 63; 299/31, 299/32, 33; 91/170 MP; 248/357

[56] References Cited

U.S. PATENT DOCUMENTS

| | | | |
|---|---|---|---|
| 3,830,070 | 8/1974 | Rosenberg et al. | 61/45 D |
| 3,885,396 | 5/1975 | Snowden et al. | 61/45 D |
| 3,902,325 | 9/1975 | Sigott et al. | 61/45 D |
| 3,915,500 | 10/1975 | Schlusener et al. | 299/32 |
| 3,928,981 | 12/1975 | Parker et al. | 61/45 D |

*Primary Examiner*—Dennis L. Taylor
*Attorney, Agent, or Firm*—Young & Thompson

[57] ABSTRACT

This invention relates to a mine roof support comprising a floor engaging member, a roof engaging member, hydraulic or other variable length struts supporting the roof engaging member, a shield pivotally connected at its upper end to the roof engaging member and a pair of links secured between a pair of pivotal connections on the lower portion of the shield and a pair of pivotal connections on the floor engaging member, so arranged as to ensure that the upper end of the shield will move in a substantially straight path perpendicular to the length of the floor engaging member. The invention provides that both shield and the top link are made of substantial width to guard against entry of debris from the goaf behind the support into the working space formed between the floor engaging member and the roof engaging member.

5 Claims, 4 Drawing Figures

MINE ROOF SUPPORT

This invention relates to a mine roof support of the kind in which a shield is supported on a floor engaging member by means of a top link and a bottom link, whereby the upper end of the shield may be constrained to move in a non-circular path relative to the floor engaging member. For preference such path approximates to a straight line perpendicular to the length of the floor engaging member. Variable length strut means will maintain, or tend to maintain, the shield at the desired position over the floor engaging member.

In a mine roof support having a shield part associated with the floor engaging part by means of the top link and the bottom link, the broad aspect of the present invention provides that the top link has a larger shielding area than the bottom link.

In accordance with a further feature of the present invention a mine roof support comprises a floor engaging member and a shield mounted on the floor engaging member by a linkage comprising a top link and a bottom link each connected between a respective first pivotal connection on the lower end portion of the shield and a respective second pivotal connection on the floor engaging member, all the pivotal connections having mutually parallel axes extending transversely to the length of the floor engaging beam and the top link having a bigger shielding area than the bottom link.

The top link may be a one-piece structure of hollow box form.

The first and second pivotal connections of the top link may each be formed by two co-axial parts located at opposite end portions of the width of the top link.

The top link may comprise a pair of spaced parallel bars and a pair of plates secured in spaced relation as by welding between the bars to provide a box form, the end portions of the bars entering the said co-axial parts of the pivotal connection.

The shield, at its end remote from the links, may pivotally carry a roof engaging canopy.

The floor engaging member may be formed of two spaced parallel components fixedly secured together.

The bottom link may comprise a pair of links, the first pivotal connections for these links being co-axial and the second pivotal connections for these links being co-axial.

A continuous space may extend between the components of the floor engaging member and the two bottom links.

At least one variable length strut may act directly between the floor engaging member and the canopy. Alternatively, at least one variable length strut may act between the floor engaging member and the shield.

The top link may have a width substantially equal to the length of the shield.

One embodiment of the invention will now be particularly described with reference to the accompanying drawings, in which.

Figure 1:
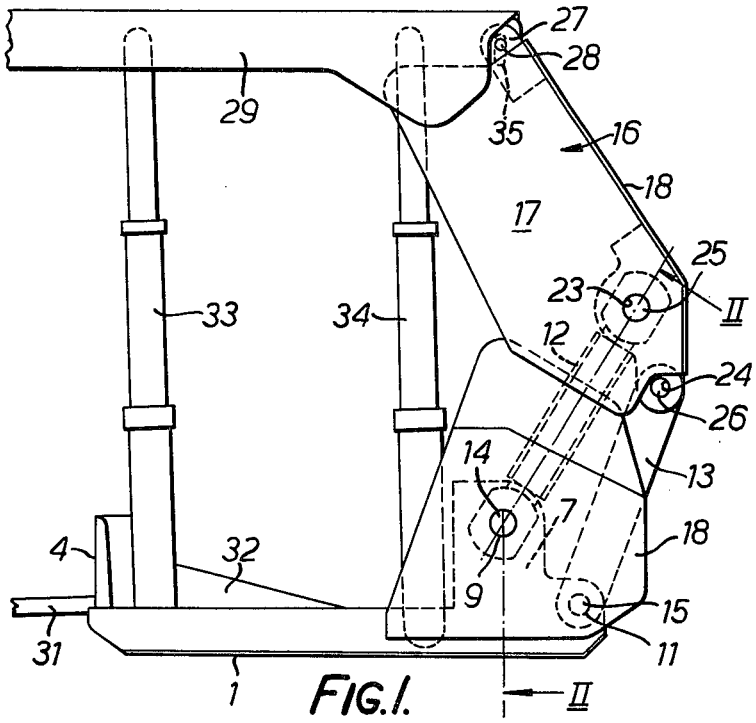
FIG. 1 is an elevation of the support.

The floor engaging member 1 is formed by a pair of spaced parallel components 2 and 3, secured together at the front by a bridge member 4 and at the rear by a bridge member 5. The rear end portions of the components are each provided with an upstanding lug respectively 6 and 7 providing between them a space 8. Each of the lugs 6 and 7 is bifurcated and is provided with a pair of pivotal holes 9 and 11, the holes 9 being co-axial with one another and the holes 11 being co-axial with one another.

The lugs 6 and 7 serve to support a top link 12 and bottom links 13 by means of pivot pins 14 in the bores 9 and pivot pins 15 in the bores 11.

The links 12 and 13 serve to support a shield 16 above the floor engaging member. The shield, as such, is of box section construction and its width is slightly greater than the overall width of the floor engaging member 1. The shield 16 includes side members 17 of thick sheet material which overlap the side members 18, also of thick sheet material extending upwardly from the outer edges of the floor engaging member 1. The shield 16 provides an exterior surface 18 covering the rear end portion of the floor engaging member against ingress of debris from the roof and the goaf.

The lower end portion of the shield 16 includes a reinforcing insert 19 which provides a pair of spaced bifurcated lugs 21 and 22. Within the lugs 21 and 22 there are a pair of co-axial top holes 23 and a pair of co-axial bottom holes 24. The top link 12 is pivotally secured to the holes 23 by means of pins 25 whilst the bottom links 13 are pivotally secured within holes 24 by means of pins 26. The holes 23 in the lugs 21 and 22, together with pins 25, form the first pivotal connection for the top link whilst the holes 24 and the pins 26 form the first pivotal connection for the bottom links. The holes 9 and pins 14 in the lugs 6 and 7 form the second pivotal connection for the top link, whilst the holes 11 and the pins 14 form the second pivotal connection for the bottom links.

The upper end of the shield 16 is provided with a lug 27 to carry a pivot pin 28. The pivot pin 28 secures the shield to a canopy 29 which extends forwardly over the floor beam and terminates in a cantilever (not shown) projecting beyond the forward end of the floor beam to cover a face conveyor. A relay bar 31 extends from the forward end of the floor engaging member for attachment to the face conveyor, a hydraulic jack accommodated between the components 2 and 3 of the floor engaging member providing thrust by which the whole roof support may pull itself towards the conveyor. Two pairs 33 and 34 of double extension hydraulic jacks are located between the floor engaging member and the canopy to urge the canopy into engagement with the roof. The jacks 33 and 34 engage pivotally both in the floor engaging member and in the canopy and are subjected only to compression forces as a result of relative movement between the canopy and the floor engaging member. The pivot pin 28 carried by the shield 16 engages in slots 35 suitably formed in the canopy to enable the canopy to tilt when accommodating itself to the roof. As an alternative the pivot pin 28 may form part of a yoke which is engaged into the canopy by means of a trunnion whose pivoting axis extends lengthwise of the canopy. Again such yoke will enable the canopy to tilt when accommodating itself to the roof.

Figure 2:
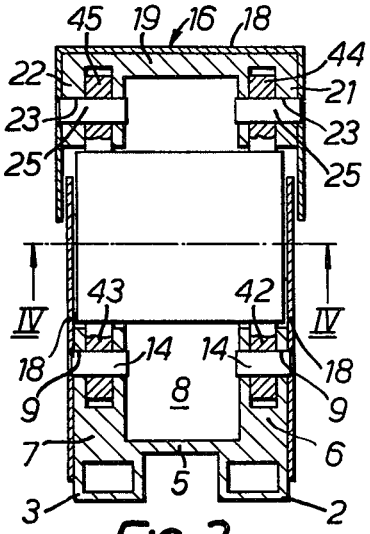
FIG. 2 is a cross-section taken on the line II—II of FIG. 1.
Figure 3:
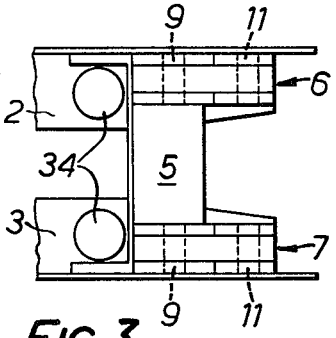
FIG. 3 is a plan view of the rear end of the floor beam.
Figure 4:
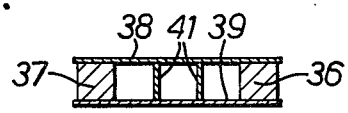
FIG. 4 is a cross-section through FIG. 2 on the line IV—IV.

The construction of the top link 12 is shown in greater detail in FIGS. 2 and 4. This link comprises a pair of steel bars 36 and 37 extending in parallel spaced relation, a pair of thick metal sheets 38 and 39 being secured in spaced relation by welding to the bars to form a box structure. Reinforcing webs 41 are welded between the sheets 38 and 39. The bars 36 and 37 project at both ends of the link to provide first lugs 44 and 45 and second lugs 42 and 43. The first lugs 44 and 45 fit into the bifurcated lugs 21 and 22 in the shield and are there pivotally located by the pins 25, thereby forming the first pivotal connection. The second lugs 42 and 43 fit into the bifurcated lugs 6 and 7 of the floor engaging member and are there pivotally located by means of the pins 14 to form the second pivotal connection. The exceedingly strong construction of the link 12 renders it very resistant to torsion and to shear forces and therefore the shield is strongly located by the link 12 against any force applied to the shield in a transverse sense which will tend to apply torsion and shear forces to the link 12.

Two narrow bottom links 13 are secured between the first pivotal connections formed by pivot pins 26 and lugs 21 and 22 and the second pivotal connections formed by pivot pins 15 and the lugs 6 and 7. The two bottom links 13 are narrow in comparison with the overall width of the top link and by their construction give very little torsional stiffness. The main function of the bottom links 13 is to resist tension and compression forces and to guide the pivot pins 26 in a circular arc about the pivot pins 15. The axes defined by the pivot pins 9, 11, 25 and 26 are all parallel to one another and transverse to the length of the floor engaging member. The relative location of the pivot pins is determined by trial and error to cause the pivot pin 28 at the free end of the shield to follow a unique approximately straight path perpendicular to the length of the floor beam during any movement of the shield relative to the floor beam. Thus, when the support is in use and there is a tendency for the roof to move relatively to the floor in the direction of the length of the floor beam the resulting force acting on the canopy is resisted entirely by the links 12 and 13 reacting through the shield onto the canopy. Raising and lowering of the canopy relatively to the floor beam is effected by the hydraulic jacks 33 and 34. Any tendency for the canopy to move transversely relative to the floor beam is resisted by the top link 12 acting in torsion and in shear as set out above.

When the support is in use it will be arranged with a plurality of similar supports in a line along a coal face in a mine, a scraper chain conveyor extending between the coal face and the front end of the floor engaging members. The forward cantilevers of the canopies will cover and give protection to this conveyor. Each support will be urged by its hydraulic jacks 33 and 34 to support the roof. Roof movement towards the floor will be controlled by the hydraulic pressure in the jacks in the well known way. Roof movement parallel to the floor which takes place either parallel to the coal face or at right angles to the coal face will be resisted by the action of the top and bottom links 12 and 13 as set out above. Debris which accumulates behind the supports due to collapse of the roof will be prevented from entering the working space between the canopy and the floor engaging member, mainly by the shields 16 but also by the top links 12 which, as illustrated, are a very close fit between the side plates 18 extending from the floor engaging members. The opening 8 at the rear end portion of each floor engaging member is a continuation of the space between the components 2 and 3 of the floor engaging member and is located between the bottom links 13. A continuous space is thus formed between the components 2 and 3 through which debris, which may enter between the canopy and the floor engaging member during mining operations, may be expelled into the goaf, particularly during the period when the support is advancing itself towards the face conveyor. The upper boundary of this space is defined by the lower edge of the plates 38 and 39 forming the top link and this position is so located as to ensure that very little debris may enter into the working space of the support from the goaf when the support is stationary.

During lowering of the roof support the bottom links 13 will move angularly towards the floor level and if it should happen that a large piece of debris is immediately adjacent the rear end of the floor beam the link 13 during lowering may make contact with this piece of debris. In the arrangement illustrated the bottom links 13 are quite narrow and spaced apart and the possibility of such narrow links making rigid contact with a piece of debris during lowering of the support are considerably reduced.

The known kind of roof support having top and bottom links to carry a shield above a floor engaging member has the bottom link arranged to act as an extension of the shield. When the described embodiment of our invention is compared with this known support it offers the following advantages:

a. The spaced lower links provide a flow passage by which debris may be ejected from the support into the goaf.

b. The spaced lower links may accommodate, if necessary, the end of the advancing jack by which the support will normally propel itself towards the conveyor.

c. The narrow lower links are less likely to engage against pieces of debris during lowering of the support.

d. The top link may have reinforcing plates secured to it over the major part of its length and provide greater torsional strength than could the bottom link if it were reinforced.

e. The box structure forming the top link need not be interrupted to provide openings, whereas any reinforcing applied to the bottom links would necessarily need to provide openings for escape of debris from the working space of the support.

f. The first pivotal connection to the upper link is closer to the roof than the first pivotal connection of the bottom link. Thus the torsion which may be applied to the top link is less than the torsion that would be applied to the bottom link when considering the transverse forces applied by the roof to the canopy. Thus, the top link will offer greater resistance than the bottom link to transverse forces applied to the canopy.

Various modifications may be made to the illustrated structure within the scope of the present invention, as follows:

a. One or more roof supporting jacks may act directly between the floor engaging member and the shield, in order to support the roof.

b. Since the bottom links are not intended to resist torsion it is possible to provide only one bottom link rather than the two narrow spaced links in the illustrated construction.

c. The two bottom links in the illustrated construction may be joined together, particularly at their upper parts, so that the bottom links may provide some torsional and shear resistance.

d. The reinforcement to the top links may be such that it provides little resistance to torsion and principally provides a shield effect. In such case the necessary strength to locate the shield in its operative position may be derived by other means, e.g. by making the bottom link torsionally resistant.

We claim:

1. A mine roof support having a floor-engaging part, a roof-engaging part, a shield of substantial width pivotally connected to the roof-engaging part to extend downwardly and rearwardly towards the goaf, a top link whose width is most of the width of the shield pivotally connected by coaxial pivots at its upper corners to the shield for movement about a first axis and pivotally connected by coaxial pivots at its lower corners to the floor-engaging part for movement about a second axis, a bottom link of a narrow width closer to the goaf than the top link, pivotally connected to the shield for movement about a third axis and pivotally connected to the floor-engaging part for movement about a fourth axis close to the floor-engaging surface, all pivot axes being substantially parallel to one another, and extendible strut means carried by the floor-engaging part to adjust the height of the roof-engaging part such that reduction in height of the roof-engaging part towards its lowest position causes the bottom link to extend from the fourth pivotal axis away from the floor-engaging part and close to the goaf side of the floor surface on which the support stands, the width and the connections of the top link locating the shield against any force applied to the shield in a transverse sense which will tend to apply torsion and shear forces to the top link and resisting any tendency for the roof-engaging part to move transversely relative to the floor-engaging part.

2. A mine roof support as claimed in claim 1, wherein the floor-engaging part includes a pair of spaced parallel beams, bridge members securing the beams together, there being a pair of said bottom links each of narrow width pivotally secured one to each beam for movement about a common fourth axis and both pivotally connected to the shield for movement about the third axis.

3. A mine roof support as claimed in claim 1, wherein the top link comprises a pair of spaced parallel bars and a pair of plates secured as by welding in spaced relation between the bars to provide the box form, the end portions of the bars forming parts of the said first and second pivotal connections.

4. A mine roof support as claimed in claim 1, wherein the floor engaging member is formed of two spaced parallel components fixedly secured together and the bottom link comprises a pair of spaced parallel links secured between the third and the fourth pivotal connections whereby to provide a continuous space between the components of the floor engaging member and the two parallel links.

5. A mine roof support as claimed in claim 1, wherein the top link is a one-piece structure of hollow box form and wherein the first and second pivotal connections are each formed of two parts located at opposite end portions of the width of the top link.

* * * * *